United States Patent [19]

Whiteley et al.

[11] Patent Number: 4,828,156

[45] Date of Patent: May 9, 1989

[54] WEB MONITORING SYSTEM

[75] Inventors: David C. Whiteley, Grand Prarie, Tex.; James B. Coffey, Dayton, Ohio; Thimothy J. Montgomery; Harvey H. Dungan, Both of Arlington, Tex.

[73] Assignee: NCR Corporation, Dayton, Ohio

[21] Appl. No.: 106,099

[22] Filed: Oct. 8, 1987

[51] Int. Cl.[4] ..... B65H 20/00; B65H 26/02

[52] U.S. Cl. ..... 226/1; 209/3.3; 226/45

[58] Field of Search ..... 226/1, 2, 11, 45, 24, 226/27, 3.3; 249/3.3

[56] References Cited

U.S. PATENT DOCUMENTS

| | | | |
|---|---|---|---|
| 3,124,289 | 3/1964 | Lynch et al. | 226/1 |
| 4,484,079 | 11/1984 | Betz et al. | 226/45 X |
| 4,673,803 | 6/1987 | Zerle et al. | 235/436 |
| 4,700,627 | 10/1987 | Hagler | 101/426 |
| 4,746,020 | 5/1988 | Schenk | 226/45 X |

OTHER PUBLICATIONS

R.K.B. Opto—Electronics, Inc., Model 2084 Ultra-Violet Hole Detector, Sep. 1985.

*Primary Examiner*—John M. Jillions

*Attorney, Agent, or Firm*—Wilbert Hawk, Jr.; Albert L. Sessler, Jr.; George J. Muckenthaler

[57] ABSTRACT

A process for monitoring defects in the material of a moving web of paper or defects in operations performed on the web of paper. An air brush spray head applies ink for a predetermined duration at a location along an edge of the moving web of paper during a press operation and after a predetermined period of time to indicate that a defect has passed. A scanner senses the ink during a subsequent collating operation so that the process line can be stopped and the defect corrected. The location of the ink on the web of paper is at a point wherein the defect has passed and good material is present.

12 Claims, 2 Drawing Sheets

WEB MONITORING SYSTEM

BACKGROUND OF THE INVENTION

In the paper industry, it is well-known that large diameter rolls of paper are processed to provide the numerous types, styles, formats, etc. of paper media that are used in the business world. From the paper manufacturing industry to the retail supplier of the paper media, there are instances wherein defects occur in the product so as to cause wasted material and/or operations or require replacement of defective goods.

In the business forms printing industry, these large diameter rolls of paper are processed to provide various types of business forms for customers to be used in their businesses. For example, one area of application in such business forms printing industry involves the use of a rotary web fed printing press and a rotary web fed collator in a process line.

In a press operation, a roll of paper is placed in position on a cradle at one end of the process line and the paper is unwound from the roll for use in one or more operations, such as printing, coating, imaging or other like operations on the paper. The paper is then rewound at the other end of the process line in either a face in or a face out manner depending upon the process and procedure employed or required in the operation.

The press operator observes the overall operation and when any defective material is found, the press is stopped, the problem is corrected, the press is restarted and the operator then manually inserts a flag in the form of a small, approximately 1"×6" strip of paper at the edge of the paper being rewound to indicate that good material is being rewound.

One of the problems encountered in working with paper media is that of defective material, such as holes in the paper, uneven splices, tears, etc. which defects require detection and correction so as to insure good products for the customers. Depending upon the extent of the defect, it may be possible to correct or to repair the defect, or if necessary, to delete the defective material from the roll of paper.

When a defect is seen by the operator at a particular position in the web of paper, the operator stops the line, corrects the problem, restarts the press and allows material to run until the defective portion or area of the paper passes and the point of good material is observed. At this point the operator flags the roll of paper to indicate that good material is running. Since a number of defects or defective portions may be observed in a roll of paper, the roll may include a number of flags sticking out from the edge in the rewound roll. It is to be noted that the manual method of flagging the paper invites some danger to the operator and also causes excessive waste of material if the operator allows excess paper to pass before a flag is inserted in the edge of the roll.

When the flagging is completed and the paper is rewound, the rewound roll is moved to a collating line where further processing and operations, such as slitting, unit forming, etc. are performed. The roll of paper may be positioned in reverse manner or the roll may be reversed to enable flow of the paper along the collating line in the reverse manner. In this respect, the flags which were placed along the paper and which are visible by the operator by reason of extending or sticking out from the edge of the roll of paper readily indicate the position of good material and that the defective material is approaching. The defective material then can be corrected or can be deleted from the roll of paper. This procedure, of course, necessitates stopping the collator machine for each and every defect in the paper material. The defect may be a hole in the paper, a number of holes at a certain location, a tear along the web of paper, defective print quality, or an uneven web splice, to name some of the common defects or problems.

Representative documentation in the field of detecting codes on continuously moving webs includes U.S. Pat. No. 4,673,803, issued to L. Zerle et al. on June 16, 1987 which discloses identification marks in the form of code fields, preceded by a starter label, arranged on a material band and recognized by a reader head.

SUMMARY OF THE INVENTION

The present invention relates to a monitoring system for web material, such as paper or like record media. The paper is driven along a path in a press operation and any defects in the paper are automatically marked so as to provide for the elimination of paper or paper products having defects or defective material. As mentioned above, the defects may include a hole in the paper, a tear in the paper, a number of holes at a certain location in the paper, defective print quality, or an uneven web splice in the paper. Such defects may be manually observed or may be detected by the operator with the use of a timing light or like device.

The present invention provides for monitoring the web of paper, for automatically marking the paper at the point or position of the defect, and for automatically sensing the marking on the web of paper. The circuitry for the press operation includes a pair of time delay relays, a programmable counter, and an air brush spray head connected to effect a web marking operation. When a defect is observed, the operator stops the press, determines the extent of the defect and corrects the problem, if feasible to do so at that time, and then restarts the press. After a predetermined time period as set by one of the time delay relays, the air brush spray head is actuated to apply a mark by use of an ink spray along the edge of the paper to indicate the position of the defect. The ink spray mark appears at the point where good material is observed at the end of the defective portion.

The circuitry for the collating operation includes a three pole relay, a beam scanner or sensing device, and a stop circuit connected to effect a web sensing operation and control for the collating machine. When the scanner or sensing device detects the spray mark along the edge of the paper that was applied during the press operation, the circuitry effects stopping the machine, the defect or problem is corrected, and the operator restarts the collating machine.

In view of the above discussion, a principal object of the present invention is to provide a monitoring system for a web of paper or like record media.

Another object of the present invention is to provide means for sensing defects in a web of paper in one operation and for identifying the defects in a later operation.

An additional object of the present invention is to provide means for sensing defects in a roll of paper and for correcting the defects so as to provide good material and/or products to the customer.

A further object of the present invention is to provide a process for identifying defective portions in a roll of paper by applying an ink marking during the press operation and for sensing the ink marking during the collating operation so that the defective portions can be corrected or the problem can be solved.

Still another object of the present invention is to provide a monitoring system that saves paper by reducing the amount of time required to detect and to correct defects in a press-collating operation.

Additional objects and advantages of the present invention will become apparent and fully understood from a reading of the following specification taken together with the annexed drawing.

DESCRIPTION OF THE PREFERRED EMBODIMENT

Figure 1:
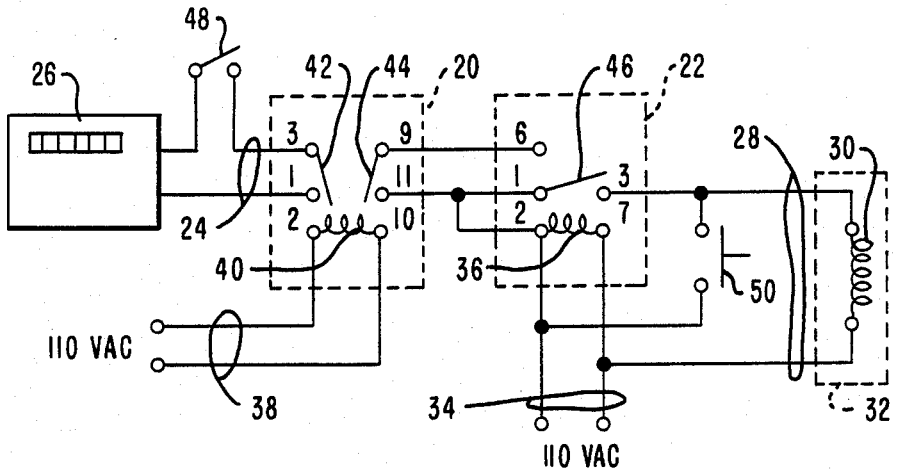
FIG. 1 is a schematic diagram of the circuitry for applying marking on a web of paper.

Referring now to the drawing, FIG. 1 is a schematic wiring diagram of the circuitry for connecting certain devices used in the web press application or operation wherein a roll of paper or like record media is placed in position at one end of a process line. The paper is unwound from the roll for the accomplishment of certain operations which may include printing on the paper, coating on one or both sides of the paper, or imaging or like recording of information or data on the paper. If during the unwinding of the paper from the roll in the press operation, a defect in the paper or in the printing, coating or recording is discovered, it is necessary that the process line be stopped, and the defect be corrected so as to provide a quality product for the customer. Of course, it may be discretionary with the operator in the case of minor defects as to whether the process line is stopped. In such case the problem may be corrected at a later time or during a later operation.

The circuitry for the press operation includes a pair of time delay relays, as 20 and 22. The time delay relay 20 is connected by wiring 24 to a programmable electronic counter 26 having memory retention, and the time delay relay 22 is connected by wiring 28 to a solenoid coil 30 of an air control valve 100 (FIG. 3) which is coupled to and is used to operate an air brush spray head 32. The time delay relays 20 and 22 (FIG. 1) are manually set to time out after a predetermined and appropriate time for each specific operation. Wiring 34 provides a 110 volt AC supply to the coil 36 of the relay 22 and wiring 38 provides a 110 volt AC supply to the coil 40 of the relay 20. The time delay relay 20 includes a pair of normally open contacts 42 and 44 and the time delay relay 22 includes a set of normally open contacts 46. A cam actuated, single pole, microswitch 48 is provided in the wiring 24 connecting the electronic counter 26 and the time delay relay 20. The switch 48 operates as an input device which is used to actuate and to initiate a measure of the impression count by the counter 26. A push button type switch 50 is connected to the wiring connecting one contact of the coil 36 of the time delay relay 22 and one contact of the set 46 of normally open contacts of the relay 22 to provide a test switch for the air brush spray head 32.

Figure 2:
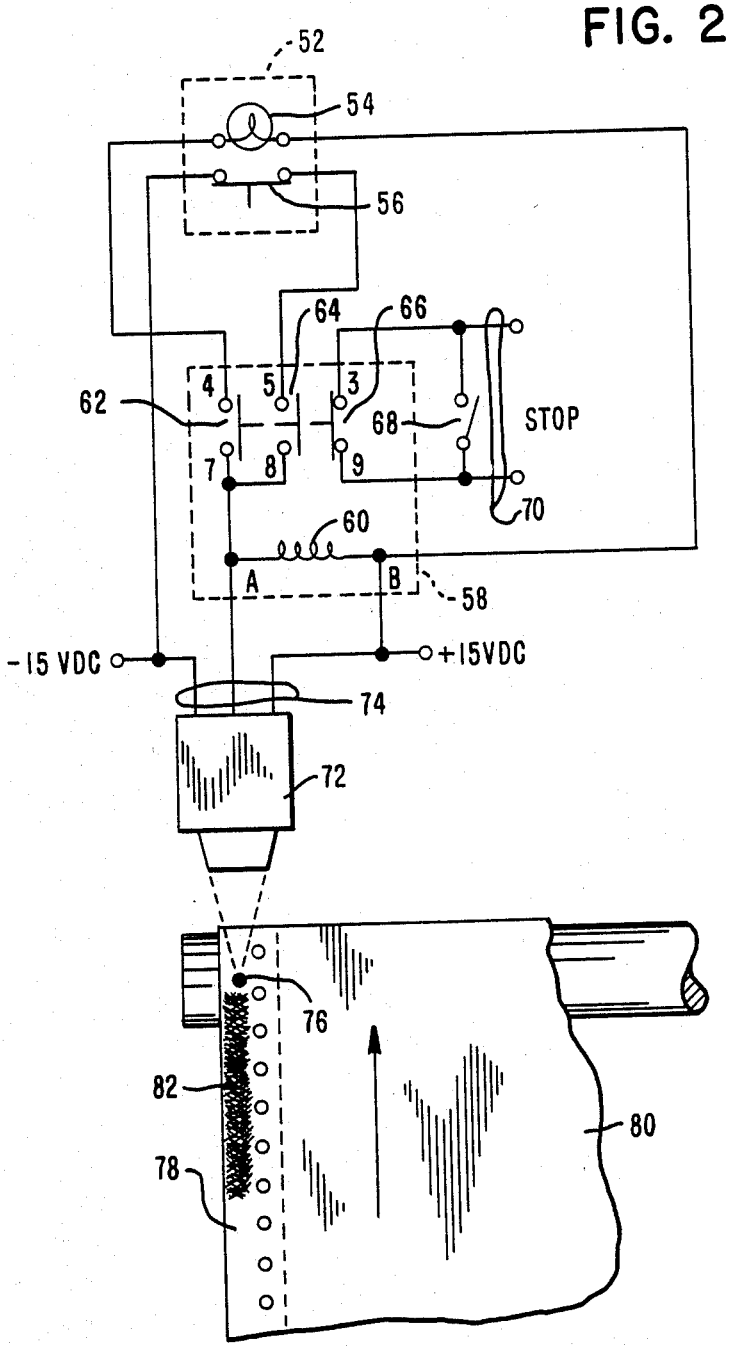
FIG. 2 is a diagrammatic representation of the web of paper along with a schematic diagram of the circuitry used for sensing the marking on the web.

The circuitry for the collator operation is shown in FIG. 2 and includes an illuminated push button operator 52 having an indicator lamp 54 and a set of normally closed contacts 56. The circuitry also includes a three pole double throw relay 58 having a coil 60 and a pair of normally open contacts 62 and 64 and a set of normally closed contacts 66. A single pole toggle switch 68 is provided in wiring 70 of a collator stop circuit and is used as a bypass switch. A beam type scanner 72 is connected to wiring 74 that includes a 15 volt DC supply and a connection to one side of the coil 60 of the relay 58 at pin A. The plus side of the 15 volt DC supply is connected to the other side of the coil 60 at pin B and the minus side of the 15 volt DC supply is connected to one terminal of the normally closed contacts 56 in the push button operator 52. The scanner 72 is positioned to project a beam at a spot location 76 on the marginal portion 78 of a web of paper 80. The spot location is focused on and aligned with a line 82 of ink spray that is applied by spray head 32 at the press operation.

The time delay relays 20 and 22 are on-delay type and are set to time out in an arrangement based on the fastest operating collator in a particular facility. A preferred nominal setting for the time delay relay 20 is 30 to 50 seconds, and a nominal setting for the time delay relay 22 is 1 to 2 seconds. In the press operation, a start-to-run switch or button is actuated to start the press operation and movement of web 80 and 110 volts is applied through wiring 38 to the coil 40 of time delay relay 20. The relay 20 starts timing out for the period of 30 to 50 seconds to allow for cleaning the printing plate (plate clean-up) so as to ensure satisfactory print quality on the web 80 of paper. As is well-known, plate clean-up time is required for water and printing ink to spread evenly on the litho plate and to start producing a printed image of good quality. The 30 to 50 seconds (any selected time within this range) is a predetermined time duration to allow for such plate clean-up and to allow for a predetermined number of satisfactory print impressions, based upon the fastest operating collator, as mentioned above. The relay 20 starts running and times out each time the press is started, as shown in FIG. 1.

At the end of the 30 to 50 seconds, the contacts 42 and the contacts 44 both close. The closing of contacts 42 enables operation of the counter 26 through operation of the cam actuated switch 48. The switch 48 is actuated by suitable means (not shown) associated with each impression of the press operation. Therefore, the counter is operated in response to and counts the number of impressions. An impression is determined by the size of the printing plate and may be a preferred length of 22 inches along the length of the web 80.

The closing of contacts 44 of relay 20 starts the timing of the time delay relay 22. Thus, the operation of the time delay relay 22 starts at the instant of or simultaneously with the timing out of the time delay relay 20. During this portion of the operation, the web 80 is moving and the press is providing or passing good material along the line. At the end of the 30 to 50 seconds, the relay 20 times out and contacts 46 of relay 22 close to operate the air brush spray head 32 for a period of 1 to 2 seconds to apply a mark 82 along the edge of the web 80. The relay 22 operates on the one shot or momentary contact principle for initiating the timing out of the relay for one to two seconds in a cycle of operation. It is during the press operation that the counter 26 is counting impressions of the printing plate as repeated lengths of material in order to agree with other areas of the overall operation. Since the collator requires at least two rolls of printed web material for the collating operation in the production of business forms, it is important that the number of impressions as repeated lengths of material and counted by the counter 26 at the press operation be coordinated for the subsequent collating operation. Therefore, the counter 26 is used to meter the number of impressions made in the press operation and which count information is important to the collator operation. It is, of course, understood that suitable start and stop means is provided for starting and stopping the web of paper in the process lines.

In the operation of the present invention, when the press operator observes a defect in the material or the print quality of the web of paper 80 as it is being unwound from the roll, or a defect in a process operation that requires attention and needs to be corrected, the operator stops the press and determines the extent of the defect. The operator then restarts the press and after a predetermined amount of time has elapsed, as determined by the timing out of the respective time delay relays 20 and 22 (FIG. 1), an ink spray mark, as 82 (FIGS. 2 and 3), is applied to the marginal portion 78 of the web 80. The ink spray mark 82 is provided to indicate the location of the defect in the web 80 and to specifically indicate the point in the web 80 at the start or the beginning of good material. In effect, the mark 82 is applied at the end of the defect and at the start of good material in the web 80. Since the relay 20 is actuated each time the press is started (whether initially started or after a defect has been observed by the operator and the press stopped) the timing out period of 30 to 50 seconds is normally sufficient to allow the defect in the moving web 80 to pass the location of the spray head 32. The timing out of the time delay relay 22 sets the predetermined time that the ink spray mark 82 is applied to the moving web 80. The 1 to 2 second timing out of the relay 22 provides a momentary or one shot operation for marking the web 80.

In a subsequent collating operation, in a reverse direction of movement of the web 80, the scanner 72 detects the ink spray mark 82 along the marginal edge 78 of the web of paper 80 (FIG. 2). Since the web 80 is unwound from a roll at the starting end of the press and the web 80 is rewound on a roll at the end of the press, the web 80 is unwound from the latter roll for the collating operation. The last portion of the web 80 that was rewound on the roll at the end of the press is the first portion of the web 80 that is unwound for the collating operation and the direction of movement of the web is reverse from that of the press operation. The pair of normally open contacts 62 and 64 of the three pole relay 58 are closed and the set of normally closed contacts 66 of the relay 58 are opened to effect stopping the collating machine. The closing of contacts 62 allows the indicator lamp 54 to be illuminated. When the defect is corrected or the defective material is deleted or removed, the collator operator restarts the machine to continue the operation. More specifically, when the scanner 72 sees the mark 82 on the web 80. the coil 60 of the three pole relay 58 is energized, the set of contacts 62 operate to illuminate the lamp 54, and the set of contacts 64 hold the relay closed. The set of contacts 66 open to stop the collating machine. When the push button 52 is operated, the set of contacts 56 open to release the relay 58 and the lamp 54 goes out, and the stop circuit set of contacts 66 close to allow restarting the collating machine at the next cycle of operation.

The various devices used in the practice of the present invention include the programmable electronic counter 26 with memory retention, Durant Model No. 5882, and supplied by Eaton Corporation, Cleveland, Ohio. The counter is a single preset type with five digit control and is capable of counting up or down. In a preferred arrangement, the counter 26 is used to count down. The counter 26 is used as a predetermined batch counter to establish the roll size of paper that is going to the collator. The counter starts counting after the time that good material is going to the collator. The counter functions used are count down, reset to preset, single pull double throw relay outputs, relay time out operation, and automatic recycle to preset.

The time delay relay 20 is a delay-on-make timing relay having a 0.06 to 160 second adjustable range, double pole, double throw outputs and supplied as AR2 series by Syrelec, Dallas, Texas. The time delay relay 22 is a single shot with single pole, double throw output and supplied as BR series by Syrelec.

The air brush spray head 32 is No. A-AUDR-000 and supplied by Paasche Air Brush Co., Harwood Heights, Illinois. A one gallon plastic container for the marking ink is supplied by Paasche and the marking ink is No. 16101-K16 black ink supplied by Sanford Corporation, Bellwood, Illinois.

Figure 3:
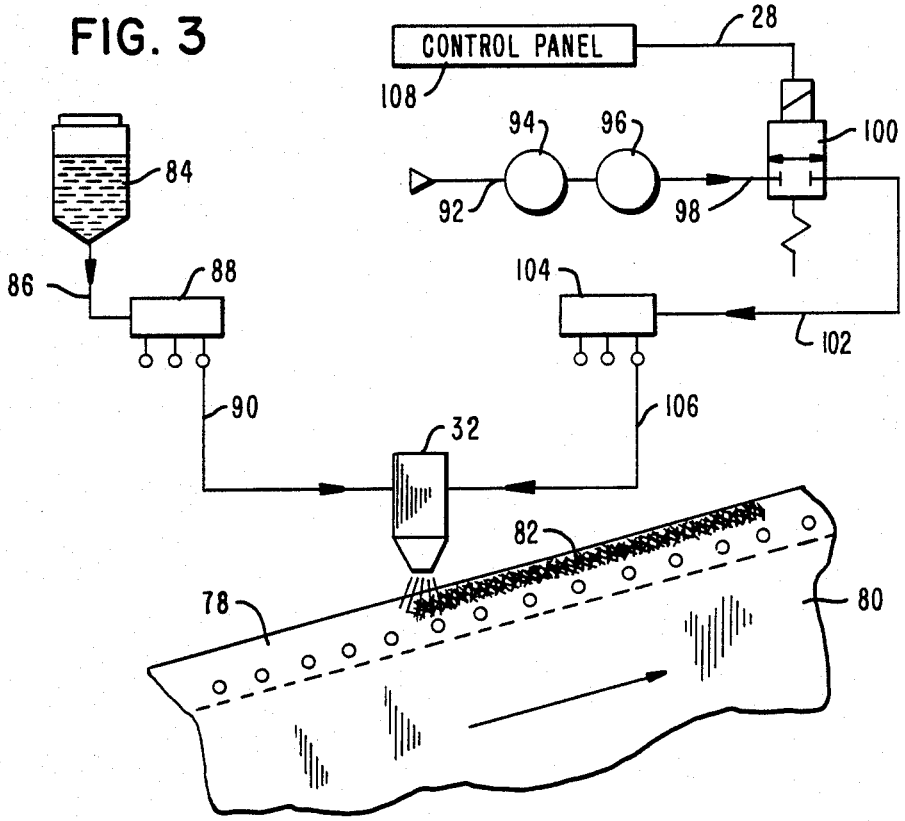
FIG. 3 is a diagrammatic representation of the parts used in the application of the marking on the paper web.

FIG. 3 is a diagrammatic representation of the parts used in applying the line 82 of ink spray on the marginal portion 78 of the paper web 80. The one gallon plastic container 84 of ink is connected with a line 86 to an ink manifold 88, in turn connected by means of a line 90 to the spray head 32. An air supply line 92 is connected to a filter 94, to a regulator 96 and air is supplied through a line 98 to an air control valve 100. Air is then supplied through a line 102 to an air manifold 104 and then through line 106 to the spray head 32. The several devices including the relays 20 and 22 and the counter 26 are contained in a control panel 108. The wiring 28 is connected as shown in FIG. 1.

The scanner 72 is a light/dark type sensor having a convergent modulating photo cell and is available as No. SM312CV from Banner Engineering Corporation, Minneapolis, Minnesota. The push button 52 is a push to test/reset device, TW series as supplied by Banner. The relay 58 is a three pole double throw relay, No. RR3PUDC12 supplied by Banner, and an appropriate power supply is No. PS120-15 by Banner.

It is thus seen that herein shown and described is a monitoring system that utilizes a pair of time delay relays in the circuitry and arrangement for detecting defects in web material or in operations associated therewith. The monitoring system of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

We claim:

1. A method of monitoring defects in material or operations performed on a continuously moving web of record media including the steps of:

starting movement of record media along a processing line, observing the moving record media, stopping the moving record media upon observing a defect therein, starting the web of record media for moving along the processing line after observing a defect in the web of record media, timing the movement of the web of record media for a first predetermined period of time to allow for preparation of a processing operation, timing the movement of the web of record media for a second predetermined period of time to allow for marking the web of record media at the end of the first predetermined period of time to indicate the end of the defect, marking the web of record media during the second predetermined period of time at one processing operation, sensing the web marking at a subsequent processing operation and indicating that a marking has been sensed on the moving web, stopping the moving web and correcting the defect sensed, and restarting the moving web after correcting the defect.

2. The method of claim 1 wherein the step of timing the movement of the record media for the first predetermined period of time provides for a delay in time to allow for passage of the moving web to obtain satisfactory web material.

3. The method of claim 1 wherein the step of timing the movement of the record media for the second predetermined period of time corresponds to the time for momentary marking of the web of record material.

4. The method of claim 1 wherein the step of marking the web comprises applying an ink spray along one edge of the moving web for a predetermined period of time.

5. The method of claim 1 wherein the step of sensing the web marking comprises scanning the edge of the moving web and focusing on the marking.

6. The method of claim 1 wherein the steps of observing a defect and marking the web of material are performed in a press operation and the steps of sensing the web marking and correcting the sensed defect are performed in a collating operation.

7. The method of claim 6 wherein the collating operation is in a direction opposite that of the press operation.

8. A system for monitoring defects in material or operations performed on a continuously moving web of paper comprising means for starting movement of said web of paper for observing defects therein, means for stopping movement of said web of paper, means for starting the web of paper along a press line of operation after observing a defect in the web of paper, first means for timing the movement of the web of paper for a first predetermined period of time to allow for passage of an observed defect in the web of paper, second means for timing the movement of the web of paper for a second predetermined period of time to allow for marking the web of paper to indicate a location of good material in the web of paper and wherein the extent of the defect has passed, means for marking the moving web of paper during the second period of time, means for sensing the marking on the web of paper which indicates the defect is approaching the marked location along a collating line of operation, and means for stopping the moving web of paper along the collating line of operation for correcting the defect.

9. The system of claim 8 wherein the first means and the second means for timing each comprises a time delay relay.

10. The system of claim 8 wherein said means for marking comprises an air brush for placing ink along an edge of the web of paper.

11. The system of claim 10 wherein said air brush comprises at least one spray head for applying ink along a location at the edge of the web of paper.

12. The system of claim 8 wherein said means for sensing the marking comprises a scanner having a photo cell and a convergent modulating beam.

* * * * *